US007314030B2

(12) United States Patent
Uehama et al.

(10) Patent No.: US 7,314,030 B2
(45) Date of Patent: Jan. 1, 2008

(54) VALVE TIMING ADJUSTING APPARATUS

(75) Inventors: Motoki Uehama, Kariya (JP); Yasushi Morii, Nagoya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/515,200

(22) Filed: Sep. 5, 2006

(65) Prior Publication Data

US 2007/0051331 A1 Mar. 8, 2007

(30) Foreign Application Priority Data

Sep. 5, 2005 (JP) ..... 2005-256779

(51) Int. Cl.
*F01L 1/34* (2006.01)

(52) U.S. Cl. ..... 123/90.17; 123/90.15; 123/90.16; 123/90.31

(58) Field of Classification Search ..... 123/90.17
See application file for complete search history.

(56) References Cited

U.S. PATENT DOCUMENTS 6,637,389 B2 10/2003 Schafer et al.
6,848,401 B2 * 2/2005 Takenaka et al. ..... 123/90.15
6,883,482 B2 * 4/2005 Takenaka et al. ..... 123/90.17
7,100,556 B2 * 9/2006 Sugiura ..... 123/90.17

FOREIGN PATENT DOCUMENTS

DE 41 10 195 C 2 2/2000
JP 9-60509 3/1997

OTHER PUBLICATIONS

U.S. Appl. No. 11/515,247, filed Sep. 5, 2006; Inv.: Uehama et al ; JP counterpart JP 2005-256778.
U.S. Appl. No. 11/514,943, filed Sep. 5, 2006; Inv.: Uehama et al.; JP counterpart JP 2005-256778.

* cited by examiner

*Primary Examiner*—Thomas Denion
*Assistant Examiner*—Kyle M. Riddle
(74) *Attorney, Agent, or Firm*—Nixon & Vanderhye P.C.

(57) ABSTRACT

A driving-side rotatable body includes a driving-side inner gear, which has an axial extent that does not overlap with an axial extent of a driven-side inner gear of a driven-side rotatable body. A driven-side outer gear and a driving-side outer gear of a planet gear are meshed with and are driven together with the driven-side inner gear and the driving-side inner gear, so that the planet gear changes a relative rotational phase between the driven-side rotatable body and the driving-side rotatable body. An addendum circle of the driving-side inner gear has a diameter, which is larger than that of a dedendum circle of the driven-side inner gear.

11 Claims, 6 Drawing Sheets

VALVE TIMING ADJUSTING APPARATUS

CROSS REFERENCE TO RELATED APPLICATION

This application is based on and incorporates herein by reference Japanese Patent Application No. 2005-256779 filed on Sep. 5, 2005. This application is also related to U.S. application Ser. No. 11/514,943, entitled "VALVE TIMING ADJUSTING APPARATUS," filed on Sep. 5, 2006 and U.S. application Ser. No. 11/515,247, entitled "VALVE TIMING ADJUSTING APPARATUS," filed on Sep. 5, 2006.

BACKGROUND OF THE INVENTION

1. Field of the Invention

The present invention relates to a valve timing adjusting apparatus that adjusts valve timing of at least one of an intake valve and an exhaust valve of an internal combustion engine that are opened and closed by a camshaft upon transmission of a torque from a crankshaft.

2. Description of Related Art

In a known valve timing adjusting apparatus, the valve timing is adjusted by changing a relative rotational phase between two rotatable bodies, which are rotated synchronously with the crankshaft and the camshaft, respectively. For example, U.S. Pat. No. 6,637,389B2 and DE4110195C2 disclose a valve timing adjusting apparatus, which changes a relative rotational phase between two rotatable bodies through use of a differential gear mechanism, which includes a planet gear as its main component.

In the case where the differential gear mechanism is used in the valve timing adjusting apparatus, an operational frequency of the differential gear mechanism, which is operated according to the operational state of the internal combustion engine, should be extremely high. Thus, frictional wearing tends to occur in the engaged sections of the gears of the differential gear mechanism. In the apparatus of U.S. Pat. No. 6,637,389B2, the lubricant oil is guided into the interior of the apparatus through the camshaft.

Furthermore, in the apparatus of DE4110195C2, two inner gears are provided to the rotatable body synchronized with the crankshaft and the rotatable body synchronized with the camshaft, respectively, and these two inner gears are placed adjacent to each other in the axial direction. Furthermore, these inner gears are meshed with two outer gears, respectively, of the planet gear. In this way, a large speed reducing ratio can be obtained with the compact design in comparison to the apparatus disclosed in U.S. Pat. No. 6,637,389B2.

In the following, the description is made with reference to an imaginary apparatus, in which the structure of guiding the lubricant oil through the camshaft recited in U.S. Pat. No. 6,637,389B2 is provided. In this imaginary apparatus, the inner gear, which is placed far from the camshaft, has a larger diameter in comparison to the inner gear, which is placed closer to the camshaft. Thus, the lubricant oil, which has passed the space between the smaller diameter inner gear and the planet gear, receives the centrifugal force of the rotatable bodies and is thereby forced to reach the space between the larger diameter inner gear and the planet gear. Therefore, in addition to the advantages of the compact design and of the large speed reducing ratio, good lubrication can be achieved. However, in the above imaginary apparatus, the foreign material, such as abrasive debris mixed into the lubricant oil, tends to adhere to the teeth of the larger diameter inner gear among the four gears. Also, in the above imaginary apparatus, an addendum circle of the larger diameter inner gear has a smaller diameter in comparison to a dedendum circle of the smaller diameter inner gear. Thus, the teeth of these gears are axially overlapped with each other and are placed adjacent to each other. As a result, when the foreign material, which is adhered to the larger diameter inner gear, is detached from the larger diameter inner gear, the detached foreign material could enter the space between the smaller diameter inner gear and its mating outer gear and thereby be clogged there. The clogged foreign material may cause operational lock or damage in the imaginary apparatus.

SUMMARY OF THE INVENTION

The present invention addresses the above disadvantages. Thus, it is an objective of the present invention to provide a valve timing adjusting apparatus, which limits operational malfunction and a damage.

To achieve the objective of the present invention, there is provided a valve timing adjusting apparatus that adjusts valve timing of at least one of an intake valve and an exhaust valve of an internal combustion engine, which are opened and closed by a camshaft upon transmission of a torque from a crankshaft to the camshaft. The valve timing adjusting apparatus includes a first rotatable body, a second rotatable body and a planet gear. The first rotatable body is rotated synchronously with one of the crankshaft and the camshaft and includes a first inner gear and at least one inlet hole. The at least one inlet hole conducts lubricant fluid into an interior of the first rotatable body. The second rotatable body is rotated synchronously with the other one of the crankshaft and the camshaft and includes a second inner gear, which is adjacent to the first inner gear and is positioned on one side of the first inner gear that is opposite from the at least one inlet hole in an axial direction. The planet gear includes a first outer gear and a second outer gear. The first outer gear and the second outer gear are meshed with and are driven together with the first inner gear and the second inner gear, respectively, to have a sun-and-planet motion, so that the planet gear changes a relative rotational phase between the first rotatable body and the second rotatable body. An addendum circle of the second inner gear has a diameter, which is larger than that of a dedendum circle of the first inner gear.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An embodiment of the present invention will be described with reference to the accompanying drawings.

Figure 2:
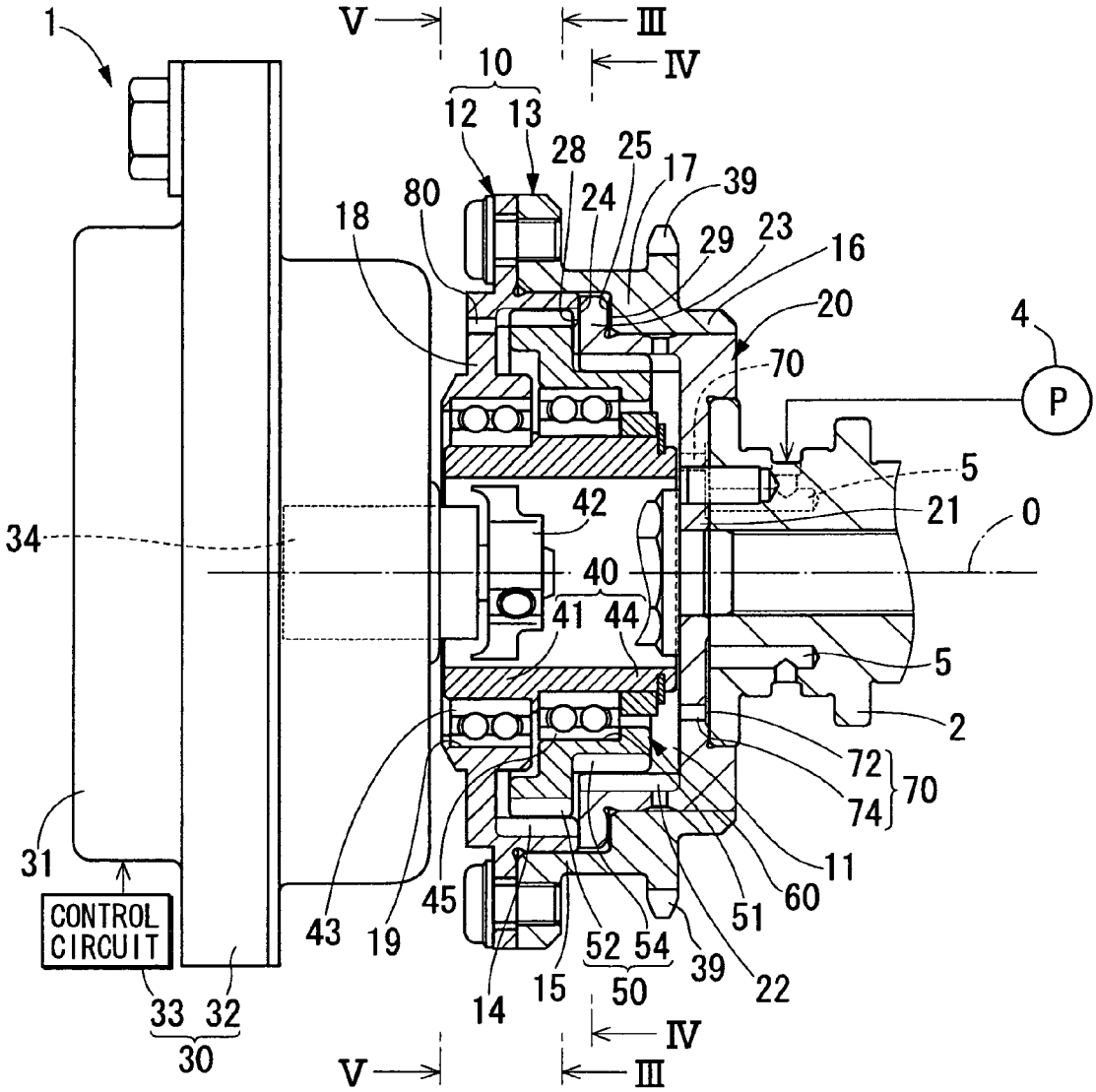
FIG. 2 is a cross sectional view taken along line II-II in FIG. 3, showing a valve timing adjusting apparatus according to the embodiment.

FIG. 2 shows a valve timing adjusting apparatus 1 according to an embodiment of the present invention. The valve timing adjusting apparatus 1 is provided in a transmission system, which transmits an engine torque from a crankshaft of an internal combustion engine to a camshaft 2. The valve timing adjusting apparatus 1 changes a relative rotational phase between the crankshaft and the camshaft 2 to adjust valve timing of an intake valve of the internal combustion engine.

The valve timing adjusting apparatus 1 includes a driving-side rotatable body 10, a driven-side rotatable body 20, a control unit 30, a planet carrier 40 and a planet gear 50.

The driving-side rotatable body 10 and the driven-side rotatable body 20 cooperate together to form a receiving space 11, which receives the planet carrier 40 and the planet gear 50.

Figure 3:
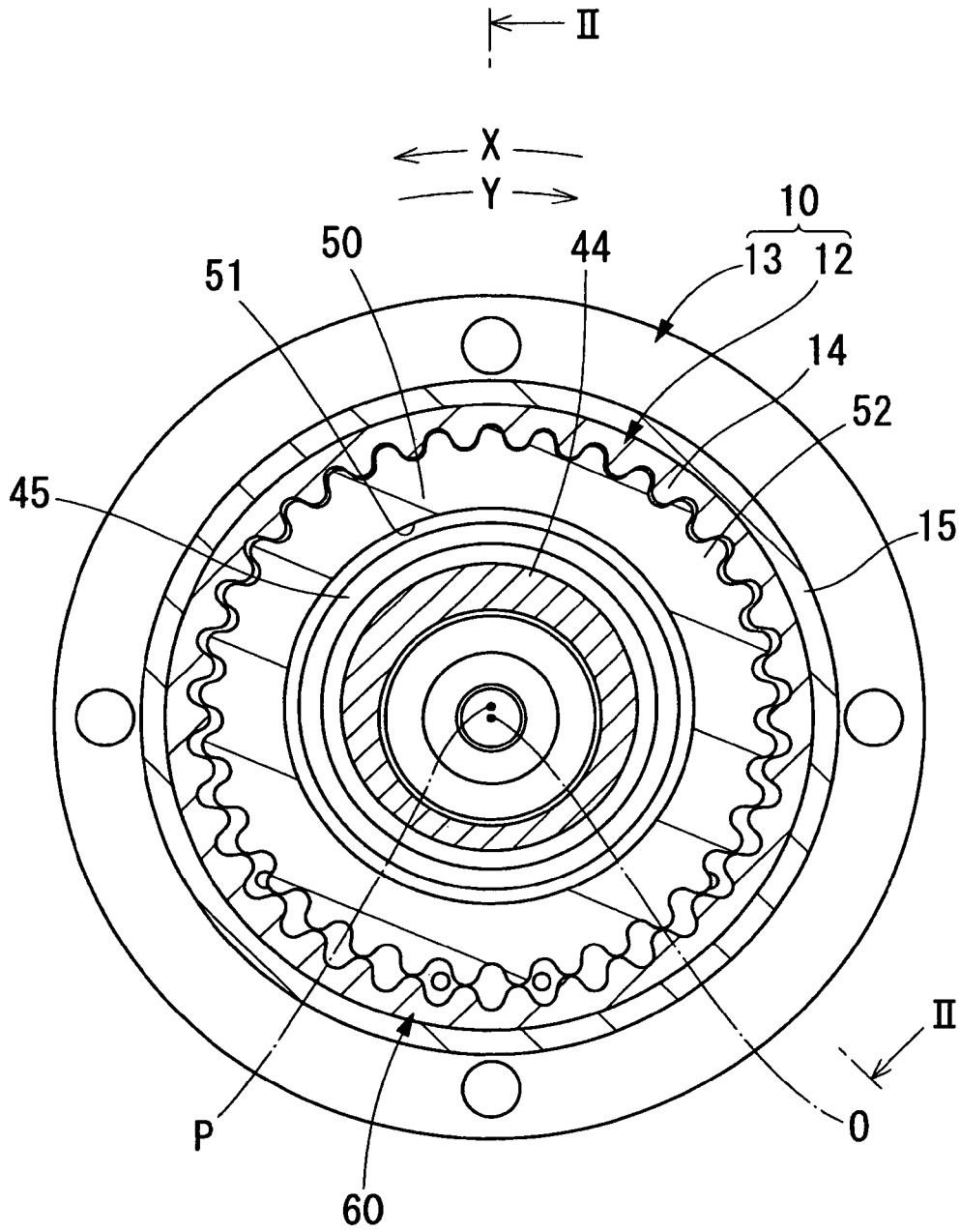
FIG. 3 is a cross sectional view taken along line III-III in FIG. 2.

As shown in FIGS. 2 and 3, the driving-side rotatable body 10 includes a cup shaped gear member 12 and a double-stepped cylindrical sprocket 13, which are coaxially arranged relative to each other. A peripheral wall of the gear member 12 forms a driving-side inner gear 14, which has an addendum circle positioned radially inward of its dedendum circle. The gear member 12 is fixed to the sprocket 13 by screws in a state where an outer peripheral wall of the driving-side inner gear 14 is engaged with an inner peripheral wall of a large diameter portion 15 of the sprocket 13. In the sprocket 13, a stepped portion 17, which connects between the large diameter portion 15 and a small diameter portion 16, includes a plurality of teeth 39, which project radially outward. An annular timing chain is wound around the teeth 39 and teeth of the crankshaft. Therefore, when the engine torque, which is outputted from the crankshaft, is supplied to the sprocket 13 through the timing chain, the driving-side rotatable body 10 is driven synchronously with the crankshaft and is thereby rotated about the rotational axis 0 while maintaining the relative phase with respect to the crankshaft. At this time, a rotational direction of the driving-side rotatable body 10 is a counterclockwise direction in FIG. 3.

Figure 4:
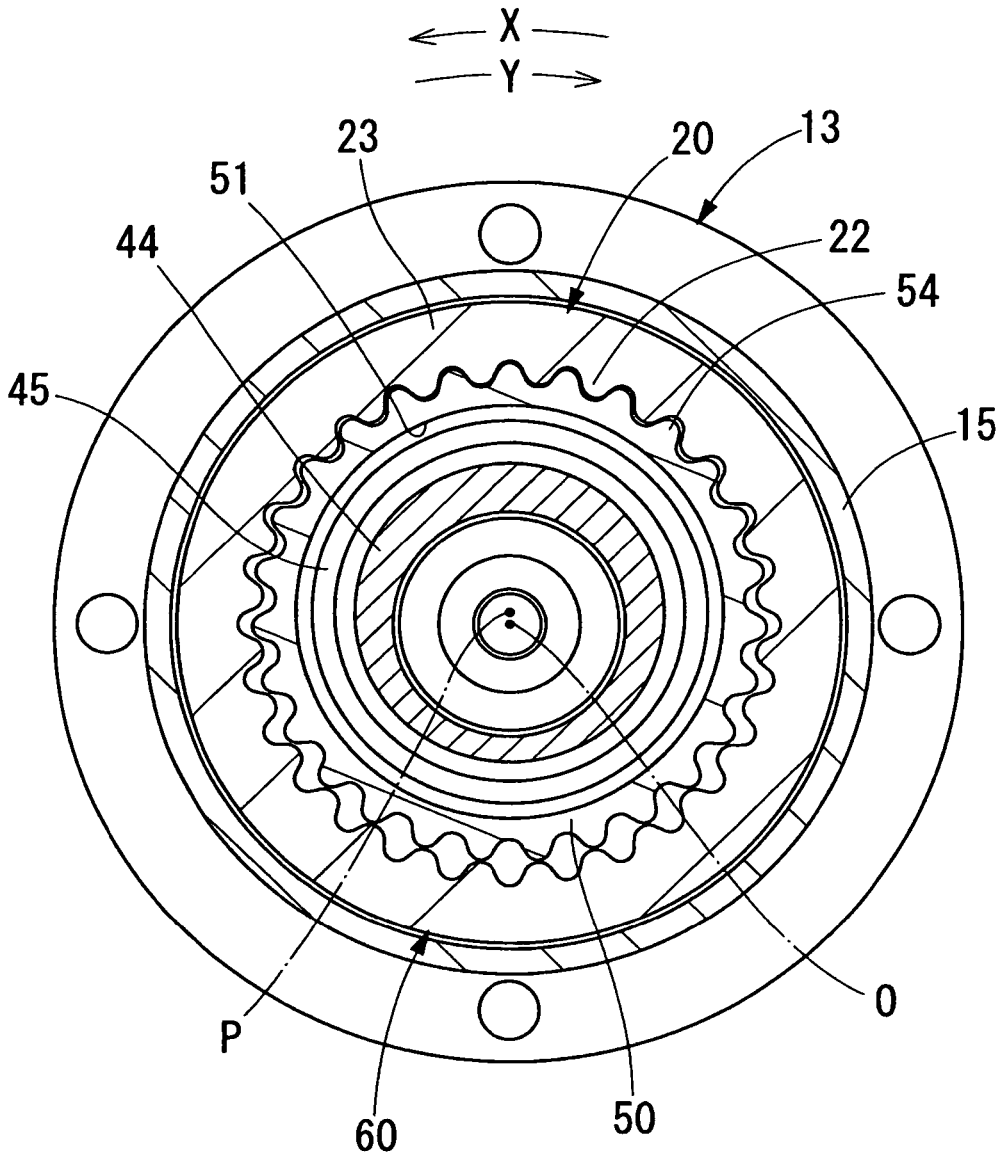
FIG. 4 is a cross sectional view taken along line IV-IV in FIG. 2.

As shown in FIGS. 2 and 4, the driven-side rotatable body 20 is a cup-shaped body and is arranged coaxial to the driving-side rotatable body 10 and the camshaft 2. A bottom wall of the driven-side rotatable body 20 forms a fixing portion 21, which is fixed to one axial end of the camshaft 2 by bolts. The driven-side rotatable body 20, which is fixed with the bolts, can be rotated synchronously with the camshaft 2 about the rotational axis 0 while maintaining the relative rotational phase with respect to the camshaft 2. Furthermore, the driven-side rotatable body 20 is relatively rotatable with respect to the driving-side rotatable body 10. In the following description, a relative rotational direction, in which the driven-side rotatable body 20 is advanced relative to the driving-side rotatable body 10, will be referred to as an advancing direction X. In contrast, an opposite relative rotational direction, in which the driven-side rotatable body 20 is retarded relative to the driving-side rotatable body 10, will be referred to as a retarding direction Y.

A peripheral wall of the driven-side rotatable body 20 forms a driven-side inner gear 22, which has an addendum circle positioned radially inward of its dedendum circle. An inner diameter of the driven-side inner gear 22 is smaller than an inner diameter of the driving-side inner gear 14. Furthermore, the number of the teeth of the driven-side inner gear 22 is smaller than the number of the teeth of the driving-side inner gear 14. An outer peripheral wall of the driven-side inner gear 22 is engaged with an inner peripheral wall of the small diameter portion 16 and an inner peripheral wall of the stepped portion 17 of the sprocket 13, so that the driven-side rotatable body 20 rotatably supports the driving-side rotatable body 10 from a radially inner side of the driving-side rotatable body 10. An axial end portion of the driven-side inner gear 22, which is opposite from the fixing portion 21, includes a flange 23, which projects radially outward. The flange 23 is clamped between an end surface 24 of the driving-side inner gear 14 and an end surface 25 of the stepped portion 17, which are axially opposed to each other. Here, axially opposed end surfaces 24, 25 of the driving-side rotatable body 10 are relatively slidably engage opposed end surfaces 28, 29, respectively, of the flange 23, and thereby axial movement of the driven-side inner gear 22 is limited. Furthermore, the driven-side inner gear 22 and the driving-side inner gear 14 are placed adjacent to each other in such a manner that an axial extent of the driven-side inner gear 22 and an axial extent of the driving-side inner gear 14 do not overlap with each other.

As shown in FIG. 2, the control unit 30 includes an electric motor 32 and a power supply control circuit 33. The electric motor 32 is arranged on an opposite side of the rotatable bodies 10, 20, which is opposite from the camshaft 2. The electric motor 32 may be, for example, a brushless motor and includes a motor case 31 and a motor shaft 34. The motor case 31 is fixed to the internal combustion engine through a stay (not shown), and the motor shaft 34 is supported by the motor case 31 in such a manner that the motor shaft 34 is rotatable in a normal direction and a reverse direction. The power supply control circuit 33 is an electric circuit, such as a microcomputer, and is arranged outside or inside of the motor case 31 such that the power supply control circuit 33 is electrically connected to the electric motor 32. The power supply control circuit 33 controls the power supply to a coil (not shown) of the electric motor 32 based on, for example, an operational state of the internal combustion engine. Through this power supply control, the electric motor 32 forms a rotating magnetic field around the motor shaft 34, so that the electric motor 32 outputs a rotational torque from the motor shaft 34 in the corresponding direction X or Y (see FIG. 5), which corresponds to the direction of the rotating magnetic field.

Figure 5:
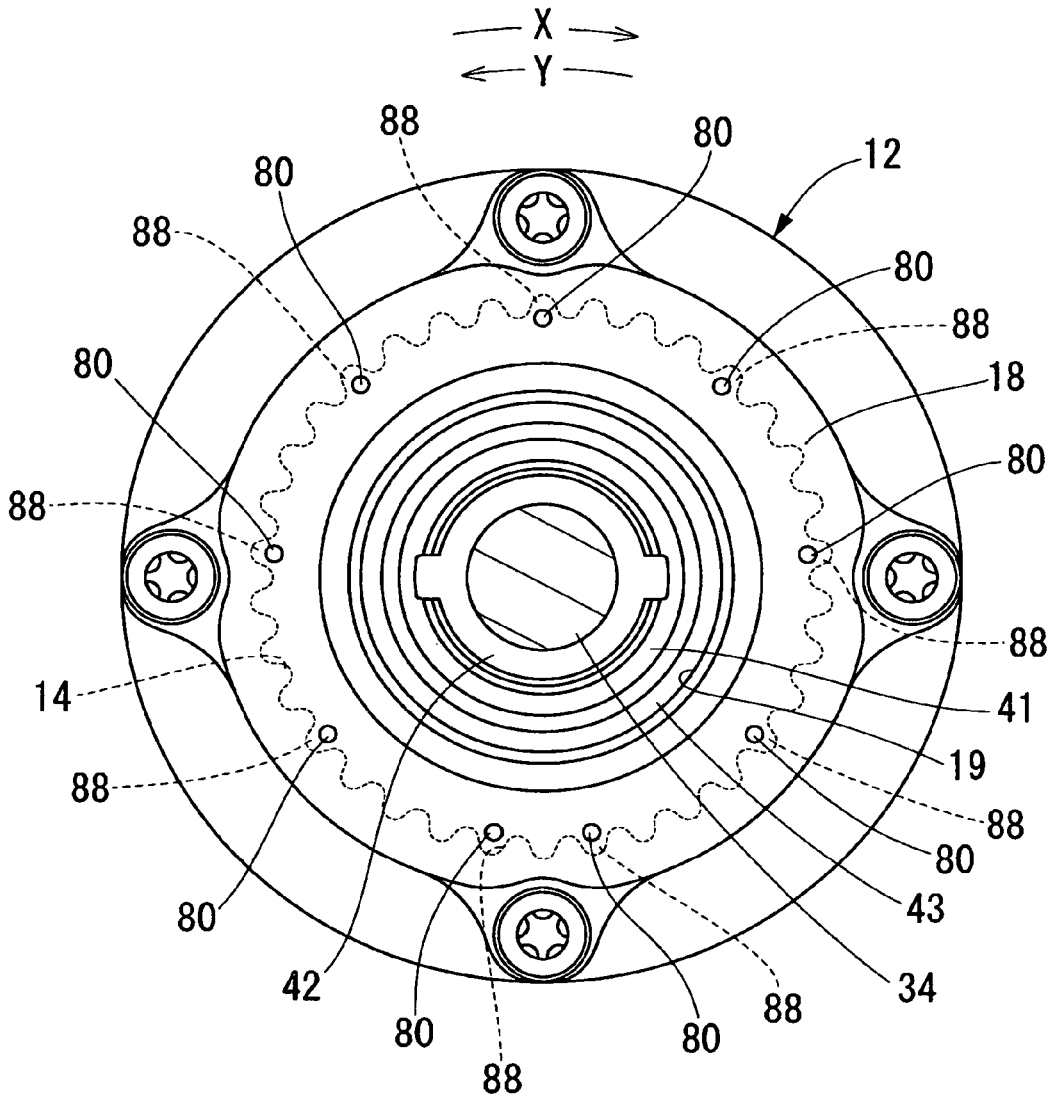
FIG. 5 is a cross sectional view taken along line V-V in FIG. 2.

As shown in FIGS. 2 and 5, an input portion 41 of the planet carrier 40 is a cylindrical body, which is coaxial with the rotatable bodies 10, 20 and the shafts 2, 34. The input portion 41 of the planet carrier 40 is fixed to the motor shaft 34 through a coupling 42. Through this fixation, the planet carrier 40 can be rotated synchronously with the motor shaft 34. Furthermore, the planet carrier 40 is relatively rotatable with respect to the driving-side rotatable body 10. The input portion 41 is arranged inside a central hole 19, which axially penetrates through a bottom wall 18 of the gear member 12. Furthermore, the input portion 41 supports the driving-side rotatable body 10 on the radially inner side of the driving-side rotatable body 10 through a bearing 43.

As shown in FIGS. 2 and 3, an eccentric portion 44 of the planet carrier 40, which is located on a fixing portion 21 side of the input portion 41, is a cylindrical body, which has an outer peripheral wall that is eccentric to the rotatable bodies 10, 20 and the shafts 2, 34. The eccentric portion 44 is arranged inside a central hole 51, which axially penetrates through the planet gear 50. The eccentric portion 44 supports the planet gear 50 on a radially inner side of the planet gear 50 through a bearing 45. Through this support, the planet gear 50 can rotate about an eccentric axis P, which is a central axis of the outer peripheral wall of the eccentric portion 44, and can revolve in the rotational direction of the eccentric portion 44. Specifically, the planet gear 50 is arranged to have a sun-and-planet motion.

As shown in FIGS. 2 to 4, the planet gear 50 is a double stepped cylindrical body and forms a driving-side outer gear 52 and a driven-side outer gear 54 at its large diameter portion and a small diameter portion, respectively. Each of the driving-side outer gear 52 and the driven-side outer gear 54 has an addendum circle positioned radially outward of its dedendum circle. Here, the number of teeth of the driving-side outer gear 52 is set to be smaller than the number of teeth of the driving-side inner gear 14 by a predetermined number N (one in this instance). Furthermore, the number of teeth of the driven-side outer gear 54 is set to be smaller than the number of teeth of the driven-side inner gear 22 by the predetermined number N. Therefore, the number of the teeth of the driven-side outer gear 54 is smaller than the number of the teeth of the driving-side outer gear 52. The driving-side outer gear 52 is arranged radially inward of the driving-side inner gear 14 to mesh with a portion of the driving-side inner gear 14. The driven-side outer gear 54, which is located on a fixing portion 21 side of the driving-side outer gear 52, is arranged radially inward of the driven-side inner gear 22 to mesh with a portion of the driven-side inner gear 22. Here, it should be understood that each inner gear 14, 22 is located radially outward of the corresponding outer gear 52, 54, and has gear teeth, which extend radially inward. Likewise, each outer gear 52, 54 is located radially inward of the corresponding inner gear 14, 22 and has gear teeth, which extend radially outward.

With the above construction, the driving-side inner gear 14 and the driven-side inner gear 22 are connected through the planet gear 50 at the radially outward of the eccentric portion 44 to form a differential gear mechanism 60 in the internal space 11 of the rotatable bodies 10, 20. In the differential gear mechanism 60, when the planet carrier 40 does not rotate relative to the driving-side rotatable body 10, the planet gear 50 rotates together with the rotatable bodies 10, 20 while maintaining the meshed position between the outer gears 52, 54 and the inner gears 14, 22. In this way, the relative rotational phase between the rotatable bodies 10, 20 is maintained, so that the valve timing is also maintained. When the planet carrier 40 is rotated relative to the driving-side rotatable body 10 in the advancing direction X due to an increase in the rotational torque in the direction X, the planet gear 50 makes the sun-and-planet motion while changing the meshed position between the outer gears 52, 54 and the inner gears 14, 22, so that the driven-side rotatable body 20 is rotated relative to the driving-side rotatable body 10 in the advancing direction X. Therefore, the valve timing is advanced. When the planet carrier 40 is rotated relative to the driving-side rotatable body 10 in the retarding direction Y due to an increase in the rotational torque in the direction Y or due to abrupt stop of the electric motor 32, the planet gear 50 makes the sun-and-planet motion while changing the meshed position between the outer gears 52, 54 and the inner gears 14, 22, so that the driven-side rotatable body 20 is rotated relative to the driving-side rotatable body 10 in the retarding direction Y. Therefore, the valve timing is retarded. Particularly, in the case where the electric motor 32 stops abruptly, it is possible to implement the valve timing at the most retarded phase, which enables the starting of the internal combustion engine.

Next, characteristic parts of the valve timing adjusting apparatus 1 will be described in detail.

Figure 6:
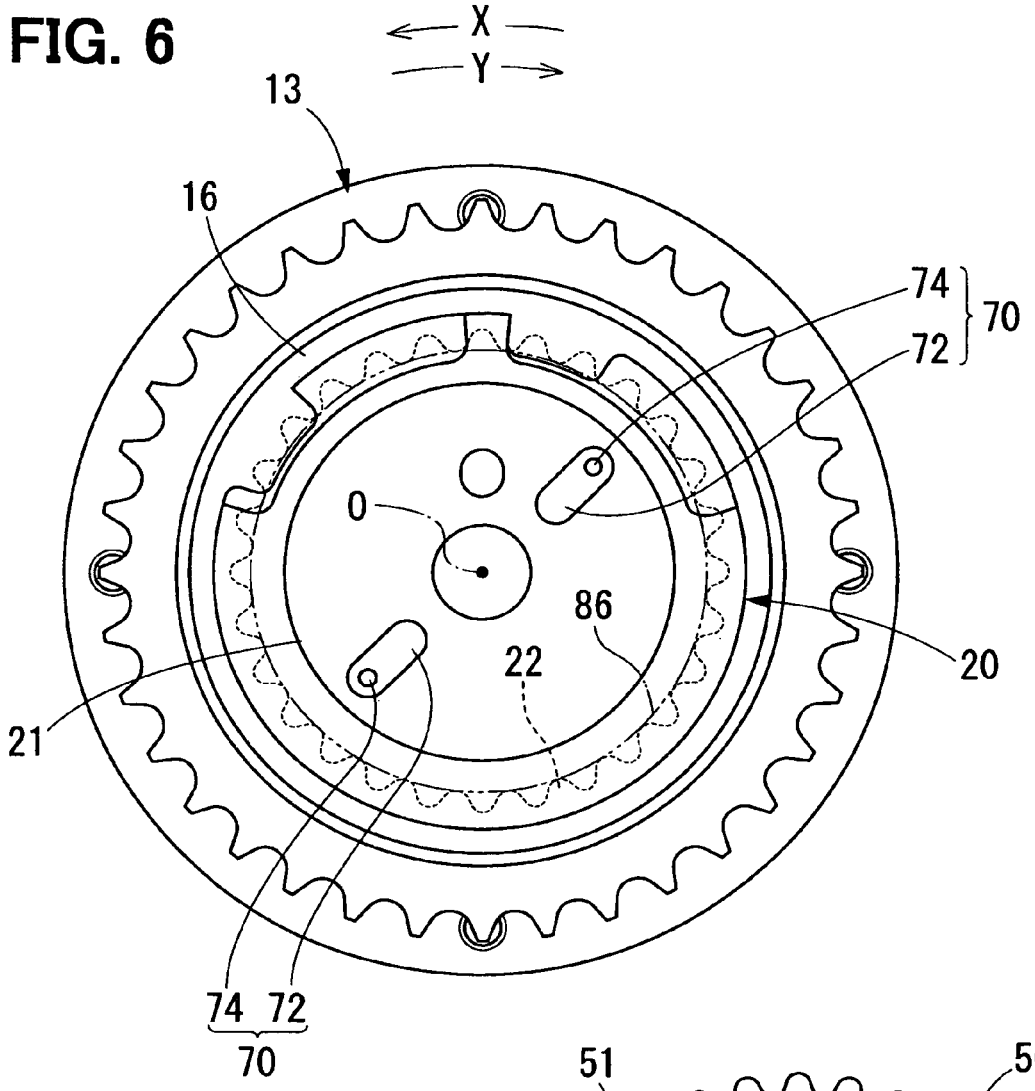
FIG. 6 is a side view of the valve timing adjusting apparatus shown in FIG. 2.

As shown in FIGS. 2 and 6, the fixing portion 21 has two inlet holes 70, which conduct internal combustion engine lubricant oil (lubricant fluid) into the internal space 11 of the rotatable bodies 10, 20. The inlet holes 70 are provided to two points, respectively, which are symmetrically arranged with respect to the rotational axis O and are thus arranged at equal intervals in a circumferential direction of the fixing portion 21, which coincides with a common circumferential direction of the inner gears 14, 22. A choke part 72 of each inlet hole 70 is formed as an elongated flat hole, which is elongated in a radial direction of the fixing portion 21. An inlet opening of each choke part 72 is communicated with a corresponding one of two supply holes 5 of the camshaft 2, into which the lubricant oil is fed from a pump 4. A flow passage cross sectional area of the choke part 72 is made smaller than a flow passage cross sectional area of the corresponding supply hole 5. A guide part 74 is provided on a downstream side of the choke part 72 in each inlet hole 70. Furthermore, the guide part 74 is formed as a cylindrical hole, which extends in an axial direction of the fixing portion 21. An outlet opening of the guide part 74 opens on a radially inner side of an addendum circle 86 of the driven-side inner gear 22 to communicate with the internal space 11 of the rotatable bodies 10, 20.

As shown in FIGS. 2 and 5, nine outlet holes 80 are formed in the bottom wall 18 of the gear member 12, which is located on an opposite side of the differential gear mechanism 60 with respect to the fixing portion 21. The outlet holes 80 are provided to conduct the lubricant oil out of the internal space 11. The outlet holes 80 are arranged at predetermined intervals in the circumferential direction of the bottom wall 18, which coincides with the common circumferential direction of the inner gears 14, 22. Furthermore, each outlet hole 80 is formed as a cylindrical hole that penetrates through the bottom wall 18 in the axial direction. An outlet opening of the outlet hole 80 opens toward an external space, which is defined between the bottom wall 18 and the electric motor 32. An inlet opening of the each outlet hole 80 opens toward a corresponding tooth space 88 of the driving-side inner gear 14 and is thereby communicated with the internal space 11.

Figure 1:
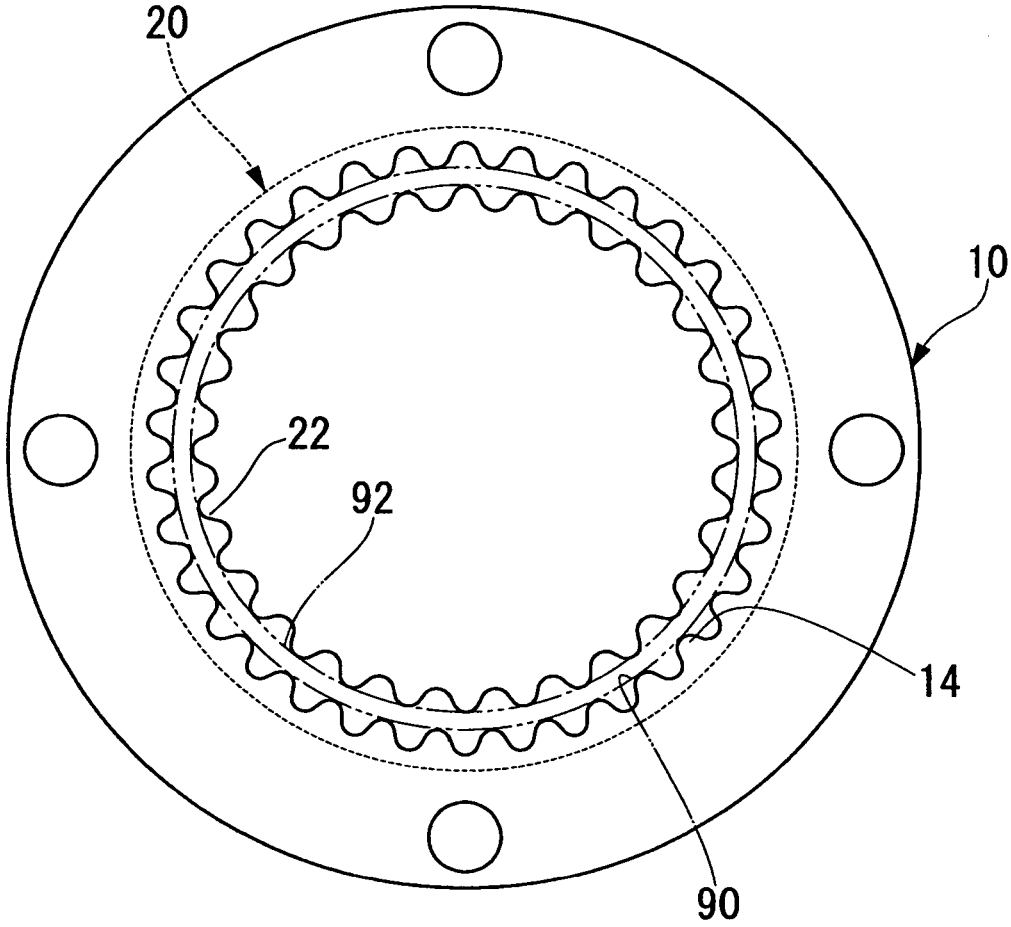
FIG. 1 is a schematic view showing a characteristic part of a valve timing adjusting apparatus according to an embodiment of the present invention.
Figure 7:
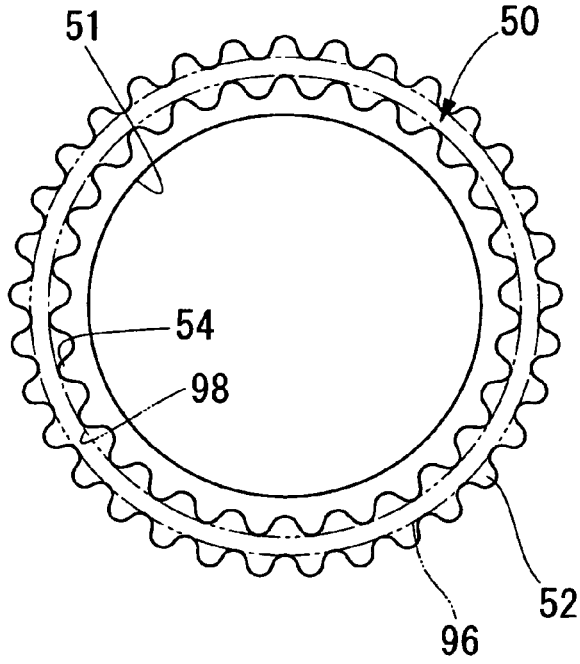
FIG. 7 is a schematic view showing a characteristic part of a valve timing adjusting apparatus according to the embodiment of the present invention.

The apparatus 1 of FIG. 1 has notable characteristics in terms of setting of diameters of the inner gears 14, 22. Specifically, in the apparatus 1, a diameter of an addendum circle 90 of the driving-side inner gear 14 is set to be larger than that of a dedendum circle 92 of the driven-side inner gear 22. In this way, as described above, although the inner gear 14 and the inner gear 22 engage with each other through the surfaces 24, 28 thereof, the teeth of the inner gear 14 and the teeth of the inner gear 22 do not overlap with each other in the axial direction and are spaced from each other in the radial direction. As shown in FIG. 7, in the apparatus 1, a diameter of a dedendum circle 96 of the driving-side outer gear 52 is set to be larger than that of an addendum circle 98 of the driven-side outer gear 54 in accordance with the diameter setting of the addendum circle 90 and of the dedendum circle 92.

In the apparatus 1 of the above structure, the lubricant oil, which is supplied to each supply hole 5, flows into each inlet hole 70 and passes through the choke part 72 of the inlet hole 70, so that the flow quantity of the lubricant oil is limited.

Therefore, the lubricant oil quantity, which is used in the apparatus 1, is limited, and thereby the influences on the lubrication of the internal combustion engine is reduced. Furthermore, in each inlet hole 70, the lubricant oil, which has passed through the choke part 72, is guided through the guide part 74 and is ejected from the outlet opening of the guide part 74 on the radially inner side of the driven-side inner gear 22. Therefore, when the lubricant oil is supplied into the internal space 11, the supplied lubricant oil receives the axial force caused by the supply pressure of the lubricant oil and also receives the centrifugal force of the rotatable bodies 10, 20, so that the supplied lubricant oil is forced to flow a space between the driven-side inner gear 22 and the driven-side outer gear 54 near the corresponding inlet hole 70. Then, the lubricant oil, which receives the above axial force and the centrifugal force, reaches and flows in a space between the driving-side inner gear 14 and the driving-side outer gear 52, which are located further away from the corresponding inlet hole 70 with respect to the driven-side inner gear 22 and the driven-side outer gear 52 and have the larger diameter in comparison to the driven-side inner gear 22 and the driven-side outer gear 52.

The above lubricant oil flow in the internal space 11 causes the lubrication between the driven-side inner gear 22 and the driven-side outer gear 54 and lubrication between the driving-side inner gear 14 and the driving-side outer gear 52. However, at the time of this lubrication, abrasive debris or powder is mixed into the lubricant oil. The mixed debris most probably adheres to the driving-side inner gear 14, which has the large diameter, among the driven-side inner gear 22, the driven-side outer gear 54, the driving-side inner gear 14 and the driven-side outer gear 52. However, in the apparatus 1, the lubricant flow, which passes the space between the driven-side inner gear 22 and the driven-side outer gear 54 and the space between the driving-side inner gear 14 and the driving-side outer gear 52, limits the adhesion of the abrasive debris or other foreign material to the driving-side inner gear 14. Furthermore, even if the debris or other foreign material is adhered to the driving-side inner gear 14, the above lubricant flow allows easy detachment of the adhered debris or other foreign material from the driving-side inner gear 14. Thus, an increase in the operational resistance, which is caused by the adhesion the debris or other foreign material, can be limited to limit a decrease in the operational response. Furthermore, in the apparatus 1, due to the characteristic diameter setting of the addendum circle 90 and of the dedendum circle 92, the driving-side inner gear 14 and the driven-side inner gear 22 do not overlap with each other in the axial direction and are spaced from each other in the radial direction. Thus, even when the adhered debris or other foreign material is detached from the driving-side inner gear 14, the detached debris or other foreign material will not easily enter the space between the driven-side inner gear 22 and the driven-side outer gear 54. Furthermore, in the apparatus 1, the inlet opening of each outlet hole 80 opens toward the tooth space 82 of the driving-side inner gear 14. Thus, the lubricant oil, which includes the debris or other foreign material, can be reliably outputted from the space between the -driving-side inner gear 14 and the driving-side outer gear 52. Therefore, it is possible to limit occurrence of the operational lock or tooth damage, which is caused by the debris or other foreign material that is bitten or clamped between the driven-side inner gear 22 and the driven-side outer gear 54 or between the driving-side inner gear 14 and the driving-side outer gear 52.

Therefore, it is possible to achieve the high response and durability of the apparatus 1, and thereby the accurate valve timing adjustment according to the rotational torque control of the control unit 30 can be maintained for a long time period.

Furthermore, in the apparatus 1, the diameter of the dedendum circle 96 of the driving-side outer gear 52, which is formed in the large diameter portion of the double-stepped cylindrical planet gear 50, is set to be larger than that of the addendum circle 98 of the driven-side outer gear 54, which is formed in the small diameter portion of the double-stepped planet gear 50. In this way, a sufficient diameter difference can be provided between the driving-side outer gear 52 and the driven-side outer gear 54. Thus, the planet gear 50, which includes the larger driving-side outer gear 52 and the smaller driven-side outer gear 54, can be easily formed by, for example, molding. Thus, it can contribute to a reduction in the manufacturing cost.

In the present embodiment, the driven-side rotatable body 20 corresponds to a first rotatable body of the present invention, and the driving-side rotatable body 10 corresponds to a second rotatable body of the present invention. Furthermore, the driven-side inner gear 22 corresponds to a first inner gear of the present invention, and the driving-side inner gear 14 corresponds to a second inner gear of the present invention. In addition, the driven-side outer gear 54 corresponds to a first outer gear of the present invention, and the driving-side outer gear 52 corresponds to a second outer gear of the present invention.

The embodiment of the present invention is described above. However, the present invention is not limited to the above embodiment and can be implemented in various other forms without departing the scope and spirit of the present invention.

Furthermore, in the above embodiment, the valve timing adjusting apparatus 1, which adjusts the valve timing of the intake valve, is described. However, the present invention can be implemented in an apparatus, which adjusts valve timing of an exhaust valve or in an apparatus, which adjusts both of the intake valve and the exhaust valve. Furthermore, in the above embodiment, there is described the valve timing adjusting apparatus 1, in which the rotatable body 10 is driven synchronously with the crankshaft, and the rotatable body 20 is rotated synchronously with the camshaft 2. Alternatively, the rotatable body 10 may be driven synchronously with the camshaft 2, and the rotatable body 20 may be driven synchronously with the crankshaft.

Furthermore, in the above embodiment, the two inlet holes 70 and the nine outlet holes 80 are provided. However, the number of the inlet hole(s) 70 and the number of the outlet hole(s) 80 may be appropriately set according to a corresponding demand. Furthermore, in the above embodiment, each inlet hole 70 includes the choke part 72 in the form of the elongated hole and the guide part 74 in the form of the cylindrical hole. Also, each outlet hole 80 is formed into the cylindrical hole. However, the configuration of each inlet hole 70 and the configuration of each outlet hole 80 can be appropriately set according to a corresponding demand.

Also, in the above embodiment, the outlet opening of each inlet hole 70 (the guide part 74) opens on the radially inner side of the addendum circle 86 of the driven-side inner gear 22. However, the configuration of the outlet opening of each inlet hole 70 may be appropriately set according to a corresponding demand. For example, the outlet opening of each inlet hole 70 may open toward a tooth space of the driven-side inner gear 22 at the radially inner side of the driven-side inner gear 22.

In addition, in the above embodiment, the inlet opening of each outlet hole 80 opens toward the tooth space 88 of the driving-side inner gear 14. However, the configuration of the inlet opening of each outlet hole 80 may be appropriately set according to a corresponding demand. Furthermore, in the above embodiment, the outlet hole 80 is provided on the opposite side of the differential gear mechanism 60, which is opposite from the inlet holes 70. Alternatively, the outlet holes may be provided on the same axial side of the differential gear mechanism 60 where the inlet holes 70 are located. In this case, the outlet holes may be provided to the driven-side rotatable body 20 or to the driving-side rotatable body 10.

Furthermore, in the above embodiment, the driving-side inner gear 14 and the driven-side inner gear 22 are engaged with each other in the axial direction. Alternatively, an axial space may be provided between the driving-side inner gear 14 and the driven-side inner gear 22.

Furthermore, in the above embodiment, the control unit 30 includes the electric motor 32 to generate the rotational torque. Alternatively, the control unit may include, for example, a hydraulic motor or an electromagnetic brake to generate the rotational torque.

Additional advantages and modifications will readily occur to those skilled in the art. The invention in its broader terms is therefore not limited to the specific details, representative apparatus, and illustrative examples shown and described.

What is claimed is:

1. A valve timing adjusting apparatus that adjusts valve timing of at least one of an intake valve and an exhaust valve of an internal combustion engine, which are opened and closed by a camshaft upon transmission of a torque from a crankshaft to the camshaft, the valve timing adjusting apparatus comprising:

a first rotatable body that is rotated synchronously with one of the crankshaft and the camshaft and includes a first inner gear and at least one inlet hole, wherein the at least one inlet hole conducts lubricant fluid into an interior of the first rotatable body;

a second rotatable body that is rotated synchronously with the other one of the crankshaft and the camshaft and includes a second inner gear, which is adjacent to the first inner gear and is positioned on one side of the first inner gear that is opposite from the at least one inlet hole in an axial direction; and a planet gear that includes a first outer gear and a second outer gear, wherein:

the first outer gear and the second outer gear are meshed with and are driven together with the first inner gear and the second inner gear, respectively, to have a sun-and-planet motion, so that the planet gear changes a relative rotational phase between the first rotatable body and the second rotatable body; and an addendum circle of the second inner gear has a diameter, which is larger than that of a dedendum circle of the first inner gear.

2. The valve timing adjusting apparatus according to claim 1, wherein a dedendum circle of the second outer gear has a diameter, which is larger than that of an addendum circle of the first outer gear.

3. The valve timing adjusting apparatus according to claim 2, wherein:

the planet gear is formed into a double stepped cylindrical body, which includes a small diameter portion and a large diameter portion;

the first outer gear is formed in the small diameter portion of the planet gear; and the second outer gear is formed in the large diameter portion of the planet gear.

4. The valve timing adjusting apparatus according to claim 1, wherein the first inner gear and the second inner gear are engaged with each other.

5. The valve timing adjusting apparatus according to claim 1, wherein an outlet opening of at least one of the at least one inlet hole opens on a radially inner side of the first inner gear.

6. The valve timing adjusting apparatus according to claim 1, wherein the at least one inlet hole include a plurality of inlet holes, which are arranged one after another in a common circumferential direction, which is common to both of the first inner gear and the second inner gear.

7. The valve timing adjusting apparatus according to claim 1, wherein the second rotatable body includes at least one outlet hole, which conducts the lubricant fluid out of the second rotatable body on an opposite side of the first inner gear and the second inner gear, which is opposite from the at least one inlet hole.

8. The valve timing adjusting apparatus according to claim 7, wherein an inlet opening of at least one of the at least one outlet hole opens toward a tooth space of the second inner gear.

9. The valve timing adjusting apparatus according to claim 1, further comprising:

a planet carrier that rotatably supports the planet gear from a radially inner side of the planet gear, wherein the planet carrier rotates in a revolving direction of the planet gear; and a control unit that controls a rotational torque applied to the planet carrier in the revolving direction.

10. The valve timing adjusting apparatus according to claim 9, wherein the control unit includes an electric motor, which generates the rotational torque.

11. The valve timing adjusting apparatus according to claim 10, wherein:

the valve timing adjusting apparatus adjusts the valve timing of the intake valve;

the first rotatable body is rotated synchronously with the camshaft;

the second rotatable body is rotated synchronously with the crankshaft; and when the planet carrier is rotated relative to the second rotatable body in a retarding direction due to the rotational torque, the first rotatable body is rotated relative to the second rotatable body in the retarding direction.

* * * * *